US006616414B2

(12) United States Patent
Yoo et al.

(10) Patent No.: US 6,616,414 B2
(45) Date of Patent: Sep. 9, 2003

(54) APPARATUS AND METHOD FOR CONTROLLING A COMPRESSOR

(75) Inventors: Jae Yoo Yoo, Gwangmyeong (KR); Jae Chun Lee, Seoul (KR); Min Kyu Hwang, Gwangmyeong (KR); Chel Woong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/931,945

(22) Filed: Aug. 20, 2001

(65) Prior Publication Data

US 2002/0090304 A1 Jul. 11, 2002

(30) Foreign Application Priority Data

Nov. 28, 2000 (KR) ..... 2000-71300

(51) Int. Cl.[7] ..... F04B 49/06
(52) U.S. Cl. ..... 417/44.1; 62/160
(58) Field of Search ..... 417/44.1, 418; 62/160, 228.1; 318/135

(56) References Cited

U.S. PATENT DOCUMENTS

| | | | | | |
|---|---|---|---|---|---|
| 4,067,667 | A | * | 1/1978 | White | 417/418 |
| 4,345,442 | A | * | 8/1982 | Dorman | 62/160 |
| 4,353,220 | A | * | 10/1982 | Curwen et al. | 62/228.1 |
| 4,474,537 | A | * | 10/1984 | Dolz | 417/44.1 |
| 5,032,772 | A | * | 7/1991 | Gully et al. | 318/135 |

FOREIGN PATENT DOCUMENTS

| | | | | |
|---|---|---|---|---|
| JP | 2001090661 | * | 4/2001 | F04B/35/04 |
| WO | WO 01/48379 | * | 7/2001 | F04B/35/04 |

* cited by examiner

*Primary Examiner*—Teresa Walberg
*Assistant Examiner*—Leonid M Fastovsky
(74) *Attorney, Agent, or Firm*—Birch, Stewart, Kolasch & Birch, LLP

(57) ABSTRACT

In an apparatus and a method for controlling a compressor, by setting a stroke reference value so as to be smaller than a maximum stroke value in a maximum load state and operating the reciprocating compressor stably, damage of a reciprocating compressor can be prevented, a cost in a motor design can be reduced, and a size of a motor can be decreased in designing of the motor.

22 Claims, 4 Drawing Sheets

APPARATUS AND METHOD FOR CONTROLLING A COMPRESSOR

BACKGROUND OF THE INVENTION

1. Field of the Invention

The present invention relates to a compressor, and in particular to an apparatus and a method for controlling a compressor which are capable of making a compressor have an optimum efficiency even in a maximum load state.

2. Description of the Prior Art

Generally, because a linear compressor does not include a crankshaft converting a rotation motion into a linear motion, the linear compressor shows a less resistance loss than a resistance loss in a general compressor, accordingly the linear compressor is superior than the general compressor in a compressing efficiency aspect.

When the linear compressor is used for a refrigerator or an air conditioner, a freezing capacity of the refrigerator or the air conditioner can be controlled by varying a compressing ratio of the linear compressor by varying a voltage applied to the linear compressor. The above-mentioned linear compressor will be described with reference to the accompanying FIG. 1.

FIG. 1 is a block diagram illustrating a construction of an apparatus for controlling a linear compressor.

As depicted in FIG. 1, the apparatus for controlling the linear compressor includes a linear compressor 13 varying an internal stroke (not shown) by being inputted a voltage supplied to an internal motor according to a stroke reference value and adjusting a freezing capacity by moving an internal piston up and down, a voltage and current detecting unit 15 detecting a voltage and a current generated in the linear compressor 13 according to the variation of a stroke, a stroke calculating unit 14 calculating a stroke by using the detected voltage and current, a comparator 11 being inputted the calculated stroke and a stroke reference value, comparing the two strokes and outputting a comparison value, and a stroke controller 12 increasing or decreasing a voltage inputted to the motor according to the comparison value. The operation of the apparatus for controlling the linear compressor will be described in detail.

First, the linear compressor 13 is inputted a voltage supplied to the motor and varies a stroke according to the stroke reference value set by a user and adjusts a freezing capacity by moving the piston up and down according to the variation of the stroke. Herein, the stroke means a distance in which the piston of the compressor 13 moves while performing a reciprocating motion.

The voltage and current detecting unit 15 detects a voltage and a current generated in the linear compressor 13 according to increase of the stroke due to the voltage applied to the motor and outputs the detected voltage and current to the stroke calculating unit 14.

The stroke calculating unit 14 calculates an actual stroke by using the detected voltage and current. In more detail, the actual stroke and a velocity of the piston can be calculated with an inductance of the motor, a motor constant, the detected current and the voltage. It can be described as below equation 1.

$$Velocity = V_m - R_{ac}I - L\frac{di}{dt},\quad Stroke = \frac{1}{\alpha}\int (Velocity)dt \qquad \text{Equation 1}$$

Herein, $V_m$ is a voltage detected at both ends of the motor of the linear compressor, I is a current applied to the motor, L is an inductance of the motor, $\alpha$ is a motor constant. Herein, the motor constant is a constant value of the motor converting an electrical power into a mechanical power, and the constant value has been determined in designing of the motor.

After, the comparator 11 is inputted a stroke reference value and a stroke value calculated in the stroke calculating unit 14 and applies a comparison value to the stroke controller 12. Herein, the stroke controller 12 varies a voltage applied to the motor according to the comparison value and outputs the varied voltage to the linear compressor 13.

When the stroke calculated in the stroke calculating unit 14 is smaller than the stroke reference value, the stroke controller 12 increases the voltage inputted to the motor, when the stroke calculated in the stroke calculating unit 14 is greater than the stroke reference value, the stroke controller 12 decreases the voltage inputted to the motor.

In the meantime, in the operation of the linear compressor, a maximum load can occur in the linear compressor 13, the maximum load is generated when power is initially applied to the linear compressor 13. It will be described with reference to the accompanying FIG. 2.

FIG. 2 is a wave form diagram illustrating a load in an initial operation of a linear compressor according to the prior art.

As depicted in FIG. 2, a maximum load works on the linear compressor 13 of the refrigerator when 10 minutes is passed after a power switch of a refrigerator is on initially, later the load is gradually decreased.

Accordingly, because even one abnormal operation can damage the internal motor, the maximum load has to be regarded in designing of the internal motor (not shown) of the linear compressor 13.

However, by regarding the maximum load in designing of the motor, a cost in the motor design is increased and a size of the motor is increased.

On the contrary, the motor is designed without regardless of the maximum load, when the motor can not stand a load, a flux saturation phenomenon serially occurs, accordingly the linear compressor can be damaged.

As described above, in the linear compressor according to the prior art, when the motor is designed regardless of the maximum load, the motor does not stand the load, the flux saturation phenomenon serially occurs, accordingly the linear compressor can be damaged.

In addition, in the linear compressor according to the prior art, when the motor is designed by regarding the maximum load, a cost in the motor design is increased.

In addition, in the linear compressor according to the prior art, when the motor is designed by regarding the maximum load, a size of the motor is increased.

SUMMARY OF THE INVENTION

Accordingly, it is an object of the present invention to provide an apparatus and a method for controlling a compressor which are capable of making a linear compressor have an optimum efficiency even in a maximum load condition.

In order to achieve the above-mentioned object, in an apparatus controlling a motor by being inputted power, there is provided an apparatus for controlling a compressor in accordance with the present invention including a maximum stroke value determining unit varying and outputting a pre-stored stroke reference value by comparing a maximum stroke value with an actual stroke value and a linear reciprocating compressor controlling power applied to an internal motor according to the varied stroke reference value.

In order to achieve the above-mentioned object, in a method for controlling a motor by being inputted power, there is provided a method for controlling a compressor in accordance with the present invention including outputting a comparison value by comparing a maximum stroke value with an actual stroke value, varying a pre-stored stroke value according to the comparison value, and controlling a voltage inputted to the motor according to the varied stroke reference value.

DETAILED DESCRIPTION OF THE PREFERRED EMBODIMENT

Hereinafter, a reciprocating compressor used for a refrigerator or an air conditioner will be described in detail with reference to the accompanying FIGS. 3~5.

Figure 1:
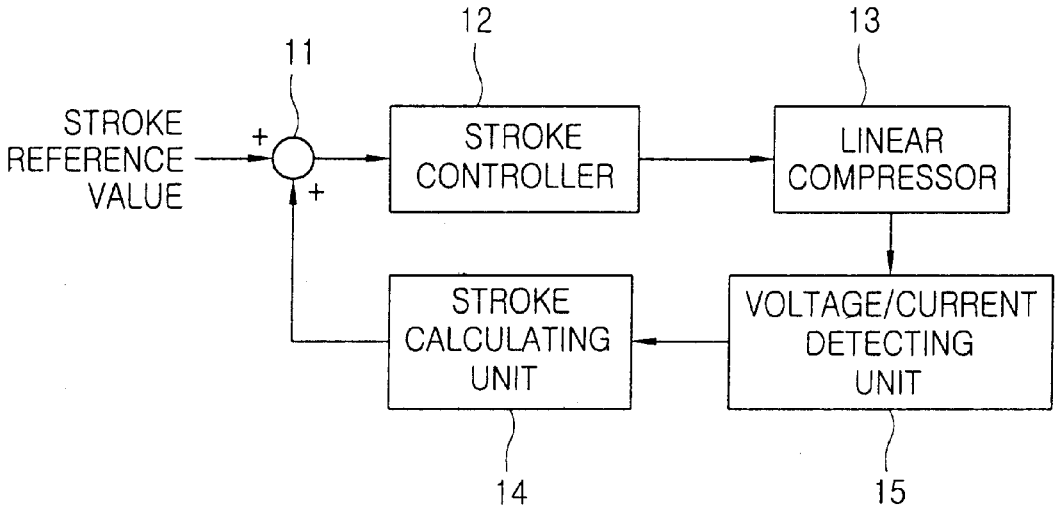
FIG. 1 CONVENTIONAL ART
FIG. 1 is a block diagram illustrating a construction of an apparatus for controlling a general linear compressor.
Figure 2:
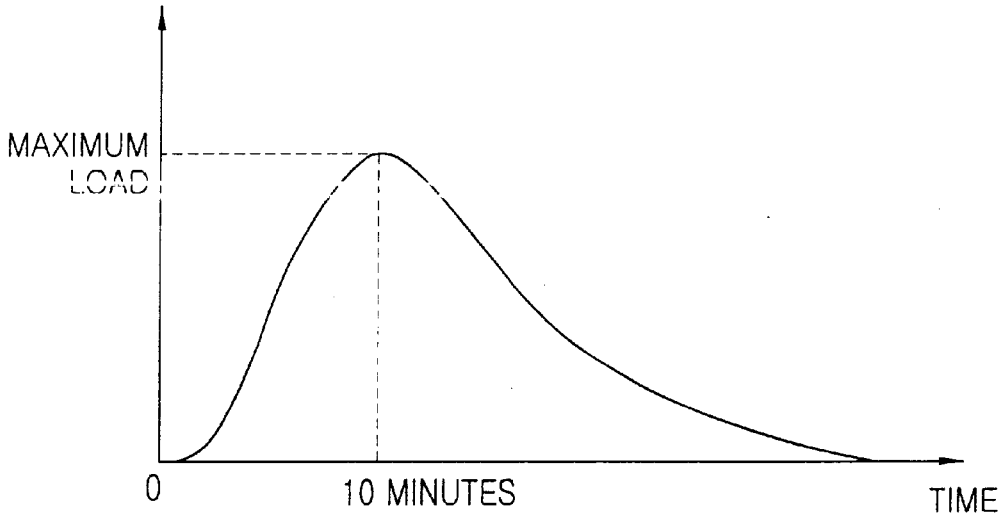
FIG. 2 CONVENTIONAL ART
FIG. 2 is a wave form diagram illustrating a load in an initial operation of a general linear compressor in accordance with the prior art.
Figure 3:
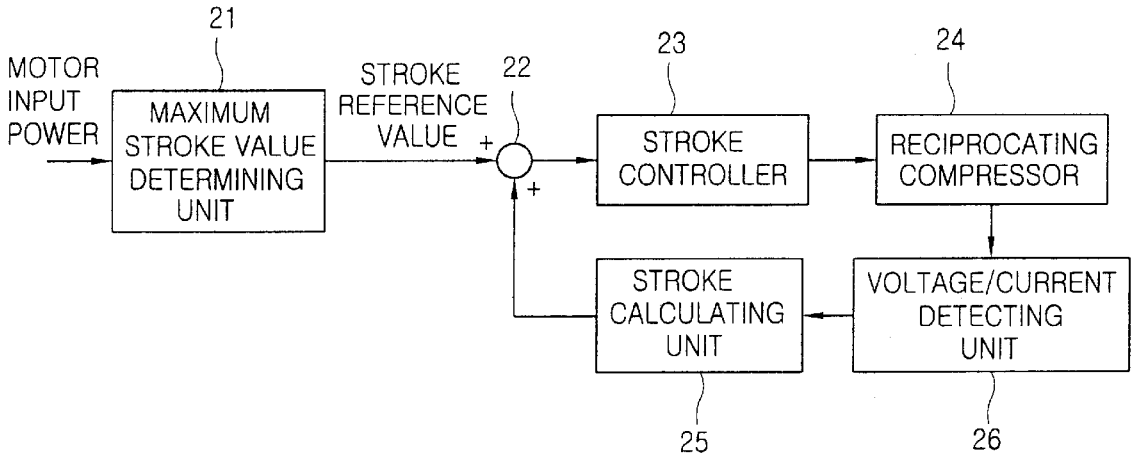
FIG. 3 is a block diagram illustrating a construction of an apparatus for controlling a reciprocating compressor in accordance with the present invention.

FIG. 3 is a block diagram illustrating a construction of an apparatus for controlling a reciprocating compressor in accordance with the present invention.

As depicted in FIG. 3, the apparatus for controlling the reciprocating compressor in accordance with the present invention includes a maximum stroke value determining unit 21 comparing a pre-stored maximum stroke value (Max ST) with an actual stroke value (Stroke Value) by being inputted power applied to the motor of the reciprocating compressor and outputting a stroke reference value (Var ST) by varying a pre-stored stroke reference value (Ref ST) so as to be not greater than the maximum stroke value (Max ST) or outputting the stroke reference value (Ref ST) as it is, a reciprocating compressor 24 varying the internal stroke by being inputted a voltage applied to the motor according to the stroke reference value (Ref ST) and the varied stroke reference value (Var ST) and adjusting a freezing capacity by moving an internal piston up and down, a voltage and current detecting unit 26 detecting a voltage and a current generated in the reciprocating compressor 24 according to the variation of the stroke, a stroke calculating unit 25 calculating an actual stroke value by using the detected voltage and current, a comparator 22 comparing the calculated stroke value with the stroke reference value (Ref ST) and outputting a comparison value, and a stroke controller 23 increasing or decreasing a voltage applied to the motor according to the comparison value. The operation of the apparatus for controlling the reciprocating compressor in accordance with the present invention will be described in detail.

First, in an initial operation of the motor of the reciprocating compressor 24, in order to prevent a maximum load condition of the motor of the reciprocating compressor 24, the maximum input stroke value determining unit 21 compares the pre-stored maximum stroke value (Max ST) with the actual stroke value (Stroke Value) and outputs the stroke reference value (Var ST) varied so as to be not greater than the maximum stroke value (Max ST) according to the comparison value to the reciprocating compressor 24 through the comparator 22 and the stroke controller 23. Herein, the maximum stroke value (Max ST) is one of power, a voltage, a current, a phase difference between a voltage and a current, a stroke value, a phase value of a current, a velocity or an acceleration of the motor (stroke) detected and stored when the maximum load works on the motor, the stroke value varies to the utmost when the maximum load works on the motor. Herein, the maximum load is generated when power is applied to the reciprocating compressor 24.

In the meantime, after the initial operation of the motor (not shown) of the reciprocating compressor 24, the maximum stroke value determining unit 21 outputs the stroke reference value (Ref ST) as it is. Herein, the stroke reference value (Ref ST) means a value for varying the stroke value into a reference value.

After, the reciprocating compressor 24 varies the stroke by being inputted voltage supplied to the motor according to the varied stroke reference (Var ST) and adjusts the freezing capacity by moving the piston up and down.

On the contrary, after the initial operation of the motor (not shown) of the reciprocating compressor 24, the reciprocating compressor 24 varies the internal stroke by being supplied the voltage to the motor according to the stroke reference value (Ref ST) and adjusts the freezing capacity by moving the piston up and down according to the varied stroke.

After, the voltage and current detecting unit 26 detects the voltage and the current generated in the reciprocating compressor 24 according to increase or decrease (variation) of the actual stroke value (Stroke Value) by the voltage inputted to the motor and outputs the detected voltage and current to the stroke calculating unit 25.

The stroke calculating unit 25 calculates the actual stroke value by using the voltage and the current detected from the voltage and current detecting unit 26.

After, the comparator 22 is inputted the stroke reference value (Ref ST) and the stroke value calculated in the stroke calculating unit 25, compares them and outputs the comparison value to the stroke controller 23.

The stroke controller 20 varies the voltage inputted to the motor according to the comparison value and outputs the varied voltage to the motor of the reciprocating compressor. Herein, the stroke controller 23 increases the voltage inputted to the motor when the stroke calculated in the stroke calculating unit 25 is smaller than the stroke reference value (Ref ST). On the contrary, the stroke controller 23 decreases the voltage inputted to the motor when the calculated stroke is greater than the stroke reference value (Ref ST).

Accordingly, when the reciprocating compressor 24 is used for a refrigerator or an air conditioner and the refrigerator or the air conditioner is initially operated, damage of the reciprocating compressor 24 is prevented by controlling the stroke reference value (Ref ST) inputted to the reciprocating compressor 24 so as to be always smaller than the maximum stroke value (Max ST) in the maximum load condition of the motor. It will be described in more detail with reference to the accompanying FIG. 4. Herein, a cause of the damage of the reciprocating compressor 24 can be described as below. When an external load (maximum load) exceeding limits of the motor of the reciprocating compressor works on, currents supplied to the motor continually increase in order to stand the load. Herein, the stroke is increased abruptly by the currents supplied to the motor, accordingly the piston or the valve of the reciprocating compressor 24 can be damaged. In addition, the motor of the reciprocating compressor 24 can be demagnetized or a coil of the motor can be burned. Herein, the demagnetization means losing a characteristic of a magnet.

Figure 4:
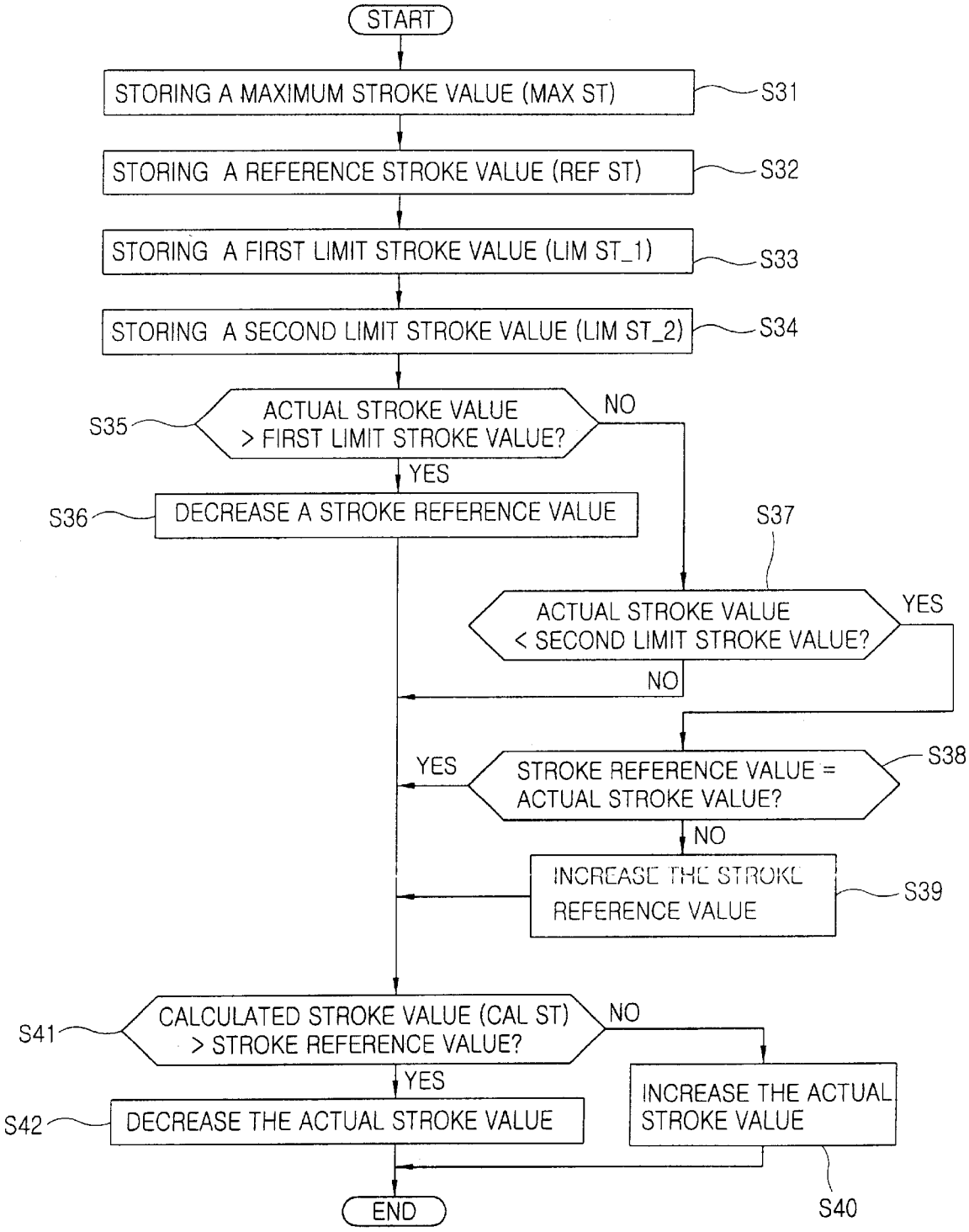
FIG. 4 is a flow chart illustrating a method for controlling a reciprocating compressor in accordance with the present invention.

FIG. 4 is a flow chart illustrating a method for controlling a reciprocating compressor in accordance with the present invention.

First, a maximum stroke value (Max ST) of the reciprocating compressor 24 is set and stored as shown at step S31. Herein, the maximum stroke value (Max ST) is the power inputted to the motor when the maximum load works on the motor, the power was detected and stored in advance, the stroke value can vary to the utmost when the maximum load works on the motor.

And, the stroke reference value (Ref ST) is set and stored as a certain value as shown at step S32. Herein, a first and a second stroke limit values (lim ST_1), (lim ST_2) are set and stored by using the maximum stroke value (Max ST) and the stroke reference value (Ref ST) as shown at steps S33 and S34. Herein, the first stroke limit value (lim ST_1) is a value calculated by subtracting a certain value from the maximum stroke value (Max ST). On the contrary, the second stroke limit value (lim ST_2) is a value calculated by subtracting two times of the certain value from the maximum stroke value (Max ST).

Herein, the maximum stroke value (Max ST), the first and the second stroke limit values (lim ST_1), (lim ST_2) and the stroke reference value (Ref ST) can be stored in a memory (not shown) of a control unit (not shown) for controlling the reciprocating compressor 24.

After, in the initial operation of the motor (not shown) of the reciprocating compressor 24, an actual stroke value is compared with the maximum stroke value (Max ST), the first and the second stroke limit values (lim ST_1), (lim ST_2), and the stroke reference value (Ref ST) is varied in order to prevent the motor from reaching to the maximum load. In more detail, a current inputted to the motor in the maximum load state is detected and stored, and the maximum input condition of the reciprocating compressor is judged by checking whether a current inputted to the motor is greater/smaller than the current inputted to the motor in the maximum load state.

For example, it is judged whether the actual stroke value is greater than the first stroke limit value (lim ST_1) as shown at step S35. Herein, the actual stroke value is calculated with the voltage and the current detected from the voltage and current detecting unit 26.

When the actual stroke value is greater than the first stroke limit value (lim ST_1), the initial operation of the reciprocating compressor 24 is controlled by decreasing the stroke reference value (Ref ST) as shown at step S36. In more detail, the voltage and the current inputted to the motor of the reciprocating compressor 24 are decreased.

After, it is judged whether the actual stroke value is smaller than the first and the second stroke limit values (lim ST_1), (lim ST_2) as shown at step S37.

When the actual stroke value is smaller than the first and the second stroke values (lim ST_1), (lim ST_2), it is compared whether the actual stroke value is same as the stroke reference value (Ref ST) as shown at step S38. Herein, when the stroke reference value (Ref ST) is different from the actual stroke value (In ST), the operation of the reciprocating compressor 24 is controlled by increasing the stroke reference value (Ref ST) as shown at step S39. In more detail, the voltage and the current inputted to the motor of the reciprocating compressor are increased.

After, the general stroke control is performed. In more detail, the actual stroke value is calculated by detecting the voltage and the current inputted to the motor of the reciprocating compressor 24, the calculated actual stroke value is compared with the stroke reference value (Ref ST), the operation for varying the voltage and the current inputted to the motor of the reciprocating compressor 24 is repeatedly performed so as to make the calculated actual stroke value be same as the stroke reference value (Ref ST).

For example, it is judged whether the calculated stroke value (Cal ST) is greater than the stroke reference value (Ref ST) as shown at step S41. Herein, when the calculated stroke value (Cal ST) is greater than the stroke reference value (Ref ST), the voltage and the current inputted to the motor are decreased as shown at step S42. On the contrary, when the calculated stroke value (Cal ST) is smaller than the stroke reference value (Ref ST), the voltage and the current inputted to the motor are decreased as shown at step S40.

Figure 5:
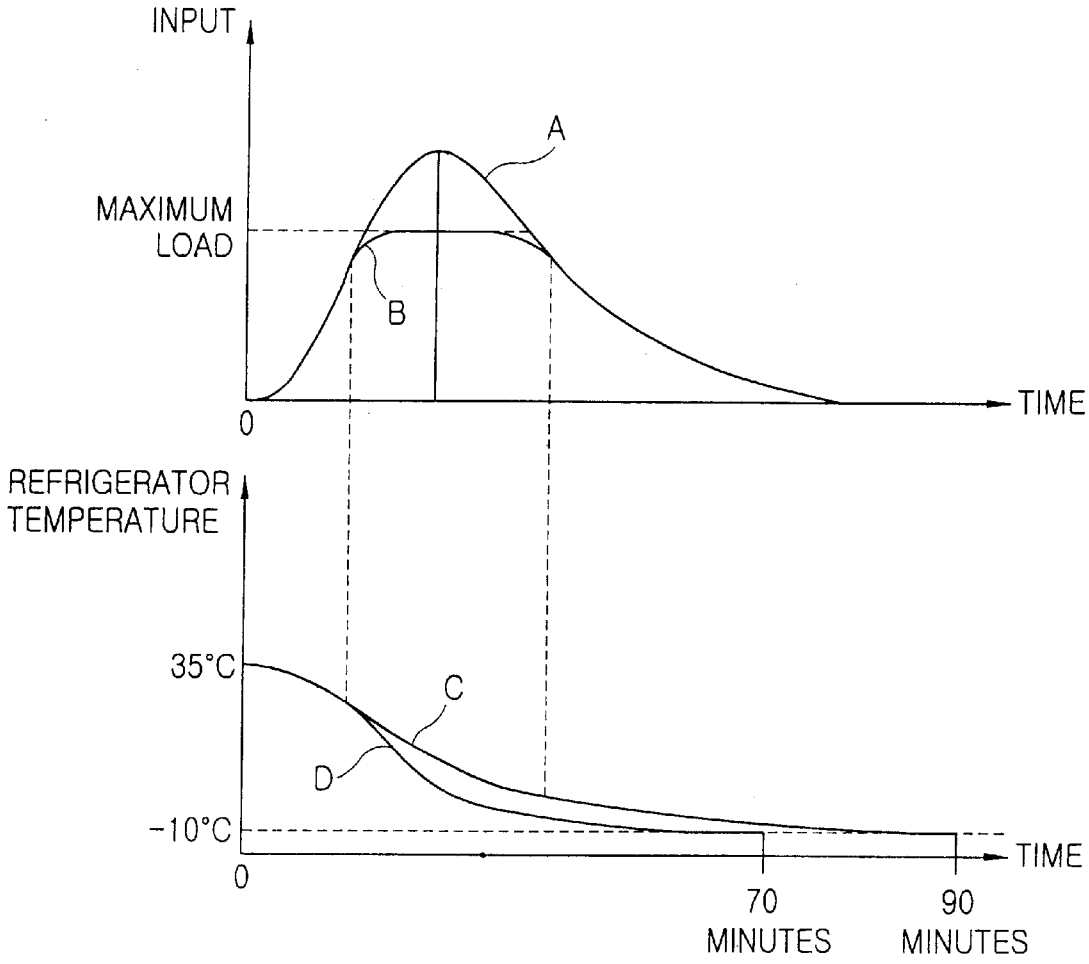
FIG. 5 is a wave form diagram illustrating a maximum load and a refrigerating velocity in controlling of a stroke of a reciprocating compressor in accordance with the present invention.

FIG. 5 is a wave form diagram illustrating a maximum load and a refrigerating velocity in controlling of a stroke of a reciprocating compressor in accordance with the present invention.

As depicted in FIG. 5, wave form diagrams A and B are graphs illustrating the maximum load in the operation of the reciprocating compressor 24.

As shown in FIG. 5, in the wave form diagram A the stroke reference value (Ref ST) is not varied in the maximum load (the maximum stroke value) state, and in the wave for diagram B the stroke reference value (Ref ST) is varied so as to be smaller than the maximum load (the maximum stroke value) in accordance with the present invention. In more detail, in the wave form diagram A, because the flux saturation phenomenon occurs in the motor in the maximum load state and the motor can be damaged, in the wave form diagram B in accordance with the present invention the stroke is varied.

Herein, the flux saturation phenomenon occurs by below reasons. First, power is generated in the motor of the reciprocating compressor 24 according to a quantity of flux, and the piston of the reciprocating compressor 24 performs a reciprocating motion up and down by the power. In more detail, the more the quantity of flux increases according to increase of the quantity of currents, the more the motor can generate power. For example, in the designing of the motor, the maximum quantity of flux flowing in the motor is determined, currents exceeding the determined quantity of flux can not flow to the motor even lots of currents are supplied. In more detail, although currents increase continuously, the quantity of flux can not be increased due to the motor design (also power moving the piston can not be increased), it is called as the flux saturation phenomenon.

In the meantime, as depicted in FIG. 5, wave form diagrams C and D are graphs illustrating a refrigerating velocity of a refrigerator. In more detail, the wave form diagram C illustrates a wave form of a refrigerating velocity of a motor designed so as to improve a refrigerating velocity of the refrigerator, and the wave form diagram D illustrates variation of a stroke in order to prevent damage of a reciprocating compressor due to a cause such as a flux saturation phenomenon, etc. in the maximum load state in accordance with the present invention. In more detail, because the maximum load occurs only once in the reciprocating compressor when a switch of a refrigerator is on for the first time after installation, there is no need to design the motor as the wave form diagram C.

Accordingly, when the reciprocating compressor 24 is controlled according to the wave form diagram D in accordance with the present invention, because a refrigerating velocity of the refrigerator is lowered in the initial operation and the refrigerating velocity of the refrigerator is improved after the initial operation, a cost related to the motor design can be reduced, and a size of the motor can be decreased.

As described above, an apparatus and a method for controlling a reciprocating compressor in accordance with the present invention can prevent damage of a reciprocating compressor by setting a stroke reference value so as to be smaller than a maximum stroke value in a maximum load state and operating the reciprocating compressor stably.

In addition, an apparatus and a method for controlling a reciprocating compressor in accordance with the present invention can reduce a cost in a motor design by setting a stroke reference value so as to be smaller than a maximum stroke value in a maximum load state and operating the reciprocating compressor stably.

In addition, an apparatus and a method for controlling a reciprocating compressor in accordance with the present invention can decrease a size of a motor by setting a stroke reference value so as to be smaller than a maximum stroke value in a maximum load state and operating the reciprocating compressor stably.

What is claimed is:

1. In an apparatus for controlling a motor by being inputted power, an apparatus for controlling a compressor, comprising:

a maximum stroke value determining unit comparing a maximum stroke value with an actual stroke value, varying a pre-stored stroke reference value and outputting the varied stroke reference value; and a compressor controlling a voltage inputted to an internal motor according to the varied stroke reference value.

2. The apparatus for controlling the compressor according to claim 1, wherein the compressor is a reciprocating compressor.

3. The apparatus for controlling the compressor according to claim 1, wherein the maximum stroke value is power detected and stored when a maximum load works on the motor.

4. The apparatus for controlling the compressor according to claim 1, wherein the maximum stroke value is a voltage or a current detected and stored when a maximum load works on the motor.

5. The apparatus for controlling the compressor according to claim 1, wherein the maximum stroke value is a phase difference between a voltage and a current detected and stored when a maximum load works on the motor.

6. The apparatus for controlling the compressor according to claim 1, wherein the maximum stroke value is a stroke value and a phase value of a current detected and stored when a maximum load works on the motor.

7. The apparatus for controlling the compressor according to claim 6, wherein the stroke value is a velocity or an acceleration of the motor (stroke).

8. The apparatus for controlling the compressor according to claim 1, wherein the stroke reference value is varied so as to be not greater than a maximum stroke value.

9. The apparatus for controlling the compressor according to claim 1, wherein the maximum stroke value determining unit varies the pre-stored stroke reference value so as to be not greater than the maximum stroke value in an initial operation of the motor.

10. The apparatus for controlling the compressor according to claim 1, wherein the maximum stroke value determining unit outputs the stroke reference value as it is.

11. The apparatus for controlling the compressor according to claim 1, wherein the compressor varies an internal stroke by controlling a voltage inputted to the motor.

12. A method for controlling a motor by being inputted power, comprising:

comparing a maximum stroke value with an actual stroke value and outputting a comparison value;

varying a pre-stored stroke value according to the comparison value; and controlling a voltage inputted to a motor according to the varied stroke reference value.

13. The method for controlling the compressor according to claim 12, wherein the motor is a reciprocating compressor.

14. The method for controlling the compressor according to claim 12, wherein the outputting process for outputting the comparison value includes the steps of:

setting and storing the maximum stroke value;

setting and storing the stroke reference value as a certain value;

setting a first and a second stroke limit values by using the maximum stroke value and the stroke reference value; and comparing the first and the second stroke limit values with the actual stroke value and outputting a comparison value.

15. The method for controlling the compressor according to claim 12, wherein the varying process includes the steps of:

decreasing the stroke reference value when the actual stroke value is greater than the first stroke value; and increasing the stroke reference value when the actual stroke value is smaller than the first stroke value.

16. The method for controlling the compressor according to claim 14, wherein the first stroke limit value is a value calculated by subtracting a certain value from the maximum stroke value.

17. The method for controlling the compressor according to claim 14, wherein the second stroke limit value is a value calculated by subtracting a certain value from the maximum stroke value.

18. The method for controlling the compressor according to claim 12, wherein the controlling process for controlling the voltage includes the steps of:

comparing the actual stroke value with the stroke reference value; and decreasing a voltage inputted to the motor when the actual stroke value is greater than the stroke reference value and increasing a voltage inputted to the motor when the actual stroke value is smaller than the stroke reference value.

19. The method for controlling the compressor according to claim 12, wherein the maximum stroke value is a power or a phase difference between a voltage and a current detected and stored when a maximum load works on the motor.

20. The method for controlling the compressor according to claim 12, wherein the maximum stroke value is a voltage or a current detected and stored when a maximum load works on the motor.

21. The method for controlling the compressor according to claim 12, wherein the maximum stroke value is a stroke value and a phase value of a current detected and stored when a maximum load works on the motor.

22. The method for controlling the compressor according to claim 21, wherein the stroke value is a velocity or an acceleration of the motor.

* * * * *